US006390962B1

(12) United States Patent
Birkenmaier et al.

(10) Patent No.: US 6,390,962 B1
(45) Date of Patent: May 21, 2002

(54) ROLLER FOR BELT STRETCHING MECHANISM

(75) Inventors: Wilhelm Birkenmaier, Weinstadt; Frank Baier, Stuttgart; Horst Howorka, Waiblingen, all of (DE)

(73) Assignee: TEXParts GmbH, Stuttgart (DE)

( * ) Notice: Subject to any disclaimer, the term of this patent is extended or adjusted under 35 U.S.C. 154(b) by 0 days.

(21) Appl. No.: 09/510,452

(22) Filed: Feb. 22, 2000

(30) Foreign Application Priority Data

Feb. 24, 1999 (DE) ..... 199 07 905

(51) Int. Cl.[7] ..... B23P 15/00
(52) U.S. Cl. ..... 492/57; 492/48
(58) Field of Search ..... 492/57, 48, 38, 492/39, 16; 57/136

(56) References Cited

U.S. PATENT DOCUMENTS 133,065 A * 11/1872 Stell
1,809,251 A * 6/1931 Pflimlin
2,718,670 A * 9/1955 Harley, Sr.
2,764,782 A * 10/1956 Cotchett
3,848,304 A * 11/1974 Lucas ..... 29/116 AD
4,356,764 A * 11/1982 Maugen ..... 100/169
4,455,727 A * 6/1984 Tschirner ..... 29/113 R
4,639,990 A * 2/1987 Schiel et al. ..... 29/116 R
5,230,618 A * 7/1993 Briemont et al. ..... 432/236
5,248,289 A * 9/1993 Carlsson et al. ..... 492/39
5,421,259 A * 6/1995 Shiba et al. ..... 101/232
5,853,832 A * 12/1998 Ishikawa ..... 428/36.2
5,893,821 A * 4/1999 Ando et al. ..... 492/59
6,010,443 A * 1/2000 Dahlbom et al. ..... 492/20

FOREIGN PATENT DOCUMENTS

CH 132 792 A 7/1929
DE 18 27 764 U 3/1961

* cited by examiner

*Primary Examiner*—Cuda Rosenbaum
(74) *Attorney, Agent, or Firm*—Michael J. Striker

(57) ABSTRACT

A roller for a belt stretching mechanism of a spinning machine has edge regions, a central zone which is depressed relative to the edge regions, and a radially movable sleeve located in a region of the central zone.

8 Claims, 1 Drawing Sheet

ROLLER FOR BELT STRETCHING MECHANISM

BACKGROUND OF THE INVENTION

The present invention relates to a roller for belt stretching mechanisms of spinning machines, with a central zone which is depressed relative to the edge regions.

In accordance with the present state of the art, such rollers for belt stretching mechanisms or so-called channel rollers are known in various embodiments. The edge regions transfer the high pressing force to the upper and lower belts for their reliable transport and exact running. In the central zone only a very low pressure must be applied through the belt to the fibers, so that on the one hand the fiber transport is guaranteed, and on the other hand the fiber pull is not prevented. There are differences between channel rollers with one channel which is ground in a rubber coating and has a predetermined depth, channel rollers with elastic channel coating, and channel rollers with non elastic edges and therefore unchangeable channel depths.

In channel rollers with edges produced of rubber, due to softness of the rubber, a flattening of the edges and thereby a reduction of the effective channel depth occurs. Because of manufacturing tolerances in the edge region, non uniform flattenings are produced, and thereby an inclined pull and braking occur in belt running. Due to the reduced channel depth, corrective measures are required, for example variations of the roller pressing force, in order to provide favorable conditions for the fiber transport and the stretching. However, slippage problems can occur during belt running.

In channel rollers with an elastic channel coating, the elasticity is provided with a full coating of the channel with the material or of an elastically coated hollow space in the channel. It is however disadvantageous that the elastic properties are significantly changed during time by wear and hardening and therefore the yarn quality suffers and there is a high maintenance expense, for example for renovating the channel coating.

In channel rollers with non elastic edge regions, the rigid channel depth is passing only for a limited yarn quality region. An excessively high depth leads to an increase of the thread breakage, while an excessively small depth reduces the yarn expansion.

SUMMARY OF THE INVENTION

Accordingly, it is an object of the present invention to provide a roller for a belt stretching mechanism, which is improved when compared with the prior art in that, on the one hand it is slippage-free and guarantees exact belt running, and a very low pressing force in the central region automatically is adjusted to the corresponding yarn quality.

In keeping with these objects and with others which will become apparent hereinafter, one feature of the present invention resides, briefly stated, in a roller for a belt stretching mechanism of spinning machines with a central zone which is depressed relative to the edge region, in which in accordance with the present invention in the region of the central zone a radially movable sleeve is arranged.

With the roller in accordance with the present invention, yarns of different qualities can expand without conversion expenses with high quality in through pulling processes. When the fibers are guided between the upper and lower belts the radially movable sleeve is provided for a light pressing force of the belt on the inserted thread. This guarantees the fiber transport without preventing the light expansion.

Since the sleeve is embraced by the belt with an angle of more than 180°, the above located belt run of the upper belt counteracts the lifting movement of the sleeve. The thickness of the fiber bundle thereby influences the pre-tensioning of the belt.

An excessively high pressure of the fiber bundle is avoided in that the sleeve is radially movable, and by the belt pull in the channel region during the belt pretensioning is pulled through the belt guide forwardly into the partial gap of the belt. Thereby the belt abuts against the fiber bundle with a force which is small but sufficient for the transport.

The elasticity of the belt is used so as to produce a slight pressing force, which the sleeve retransmits to the fiber bundle. The pressing force acts so that on the one hand the fiber transport is guaranteed without fiber breakage, and on the other hand in the fiber bundle only such pulling forces are produced which do not reduce the yarn expansion.

For an optimal pressing force of the rollers against the fiber bundle, the outer diameter of the sleeve can be equal to a diameter of the both end regions or insignificantly different from it.

The sleeve can have an axial gap in both end regions. This provide an optimal fiber guide.

The roller can be composed of two mirror-symmetrical parts including an edge region and an axial projection, for providing a definite axial gap for the sleeve. The axial projection contacts and limits the radial deviation of the sleeve. The surrounding edges and the sleeve can be formed as a synthetic plastic part. This provides for a cost favorable manufacture of the roller.

For better use of the properties of the sleeve for the pressing force, the sleeve can be composed of a material with high density or with great wall thickness.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 1:
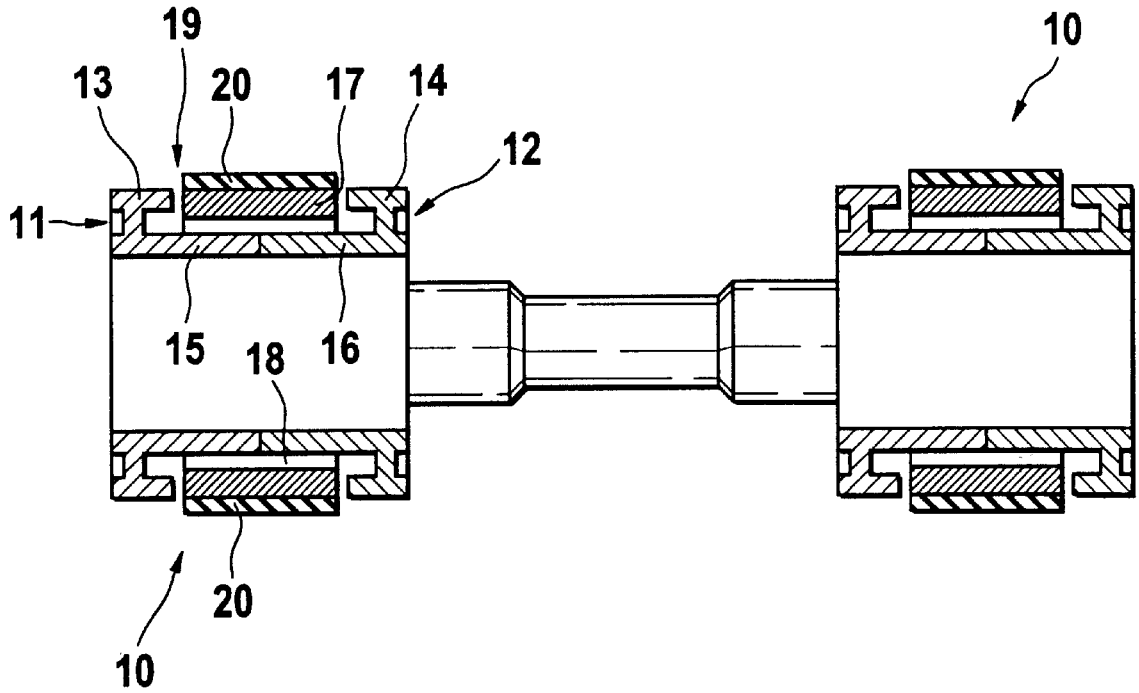
FIG. 1 is a view showing a longitudinal section through an upper roller for a belt stretching mechanism in accordance with the present invention.

FIG. 1 shows an upper roller of a belt stretching mechanism, which is formed in accordance with the present invention. The upper roller has two channel rollers 10. Each channel roller 10 is composed of two mirror-symmetrical, identical parts 11 and 12. The two mirror symmetrical identical parts 11 and 12 are composed of an edge region 13 and 14 correspondingly, and an axial projection 15 and 16 correspondingly.

The axial projections 15 and 16 abut in the center of the roller 10 against one another. They form a channel of the roller 10. The both actual projections 15 and 16 are surrounded by a sleeve 17. The sleeve 17 for an optimal pressing force has a radial gap 18 which can be more clearly seen in the drive belt 20 shown in FIG. 2. For an optimal fiber running, the sleeve 17 also has an axial gap 19.

Figure 2:
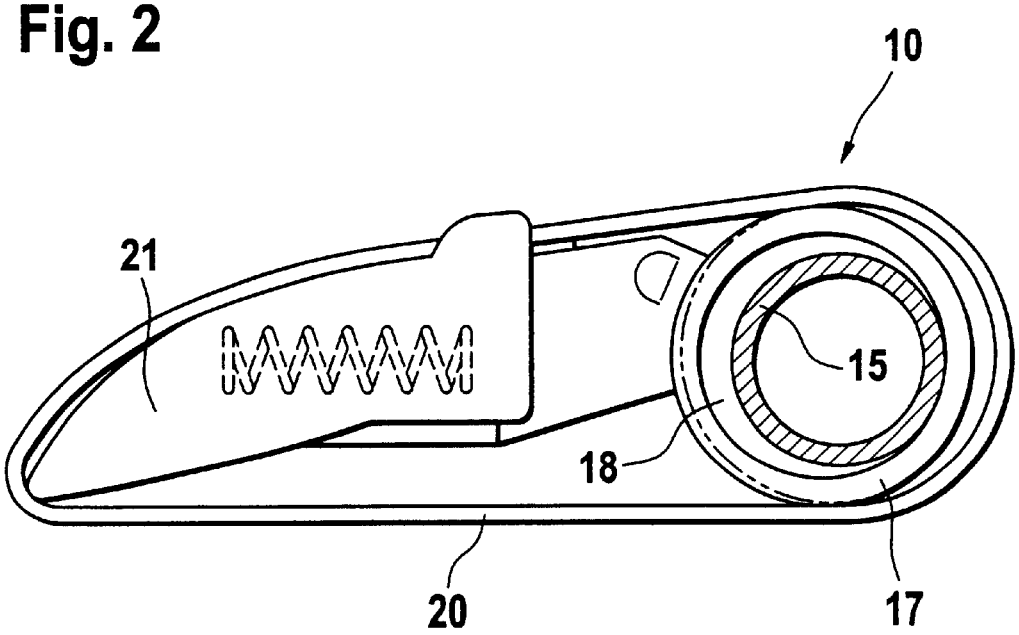
FIG. 2 is a view showing a section side view of the upper roller for the belt stretching mechanism of FIG. 1, with a belt guide.

FIG. 2 shows the roller 10 which in addition to other features has the axial projection 15. The axial projection 15 is surrounded by the sleeve 17. A belt 20 surrounds the roller 10 together with the sleeve 17 and is also guided over a belt guide 21.

The sleeve 17, because of the belt tensioning of the belt 20, lies with a very low pressure on the fiber bundle. It can be adjusted by a radial gap 18 relative to the axial projections 15 and 16 automatically to the thickness of the fiber bundle. In particular it is achieved in that it performs a deviating movement toward the belt guide 21 In this position the sleeve 17 runs around the belt 20 and the parts 11 and 12 without wear.

It will be understood that each of the elements described above, or two or more together, may also find a useful application in other types of constructions differing from the types described above.

While the invention has been illustrated and described as embodied in roller for belt stretching mechanism, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by letters patent is set forth in the appended claims.

What is claimed is:

1. A roller for a belt stretching mechanism of a spinning machine, comprising edge regions; a central zone which is depressed relative to said edge regions; and a radially movable sleeve located in a region of said central zone.

2. The roller as defined in claim 1, wherein said sleeve has an outer diameter which is equal to a diameter of said edge regions.

3. The roller as defined in claim 1, wherein said sleeve has an outer diameter which is insignificantly different from a diameter of said edge regions.

4. The roller as defined in claim 1, wherein said sleeve has an axial gap between said edge regions.

5. The roller as defined in claim 1; and further comprising two mirror-symmetrical parts which together form the roller, each of said parts having an edge region and an axial projection, said axial projections contacting and limiting a radial deviation of said sleeve.

6. The roller as defined in claim 1, wherein said edges and said sleeve are formed as synthetic plastic parts.

7. The roller as defined in claim 1, wherein said sleeve is composed of a material having a high density.

8. The roller as defined in claim 1, wherein said sleeve has a great wall thickness.

* * * * *